US010364135B1

(12) United States Patent
Lindley et al.

(10) Patent No.: US 10,364,135 B1
(45) Date of Patent: Jul. 30, 2019

(54) PROTECTION BUMPER FOR A VEHICLE HANDLING FORK

(71) Applicants: Adam W. Lindley, Green Bay, WI (US); Colten D. Jensen, Green Bay, WI (US)

(72) Inventors: Adam W. Lindley, Green Bay, WI (US); Colten D. Jensen, Green Bay, WI (US)

(73) Assignee: S.A.S. OF LUXEMBURG, Luxemburg, WI (US)

( * ) Notice: Subject to any disclaimer, the term of this patent is extended or adjusted under 35 U.S.C. 154(b) by 250 days.

(21) Appl. No.: 15/482,923

(22) Filed: Apr. 10, 2017

(51) Int. Cl.
*B66F 9/12* (2006.01)
*B66F 9/075* (2006.01)

(52) U.S. Cl.
CPC ..... *B66F 9/12* (2013.01); *B66F 9/07504* (2013.01)

(58) Field of Classification Search
CPC .... B66F 9/127; B66F 9/12; B66F 9/02; B66F 9/07563
See application file for complete search history.

(56) References Cited

U.S. PATENT DOCUMENTS 2,956,701 A * 10/1960 Larson ..... B66F 9/12 414/608
3,080,080 A 3/1963 Miller
4,102,464 A * 7/1978 Schuster ..... B66F 9/12 293/107
5,220,980 A * 6/1993 Petter ..... B65D 19/38 187/237
6,146,081 A * 11/2000 Anderson ..... B66F 9/12 37/405
8,210,790 B1 * 7/2012 Sharp ..... B66F 9/12 414/639
2006/0054453 A1 * 3/2006 Marcelli ..... B60P 1/52 193/35 R
2009/0008951 A1 1/2009 Whetstine et al.
2011/0198157 A1 * 8/2011 Sharp ..... B66F 9/12 187/222
2016/0090286 A1 * 3/2016 Belotti ..... B66F 9/165 414/607
2018/0037448 A1 * 2/2018 Lacher ..... B62B 3/06

FOREIGN PATENT DOCUMENTS

FR 2 598 697 11/1987

* cited by examiner

*Primary Examiner* — Diem M Tran
(74) *Attorney, Agent, or Firm* — Donald J. Ersler

(57) ABSTRACT

A protection bumper for a vehicle handling fork preferably includes a bumper portion and an attachment bracket. The bumper portion preferably includes the shape of a substantial right hand triangle. At least two through cavities are formed in a thickness of the bumper portion. The first and second cavities allow an angled side of the bumper portion to deflect. The attachment bracket preferably includes a C-shaped cross section. An inside width of the C-shaped cross section is sized to receive a thickness of the bumper portion. The attachment bracket is preferably attached to the bumper portion with at least one fastener. The attachment bracket may be welded to a vertical portion of a fork member of the vehicle handling fork. Alternatively, a retention strip extending from the vertical portion of the fork member is inserted into a gap between the attachment bracket and the bumper portion.

10 Claims, 6 Drawing Sheets

PROTECTION BUMPER FOR A VEHICLE HANDLING FORK

BACKGROUND OF THE INVENTION

1. Field of the Invention

The present invention relates generally to vehicle salvage handling and more specifically to a protection bumper for a vehicle handling fork, which protects a front bumper of a vehicle from damage that may be caused during use of the vehicle handling fork.

2. Discussion of the Prior Art

The prior art teaches putting a substantially rectangular bumper on a vertical portion of a fork of a forklift. Patent no. 3080080 to Miller discloses a shock absorbing attachment for forklift trucks. Patent no. FR 2598697 to Forgeas discloses bumpers for a forklift. Patent publication no. 2009/0008951 to Whetstine et al. discloses a protective bumper adapted for minimizing damage to materials carried by a materials handling vehicle.

Accordingly, there is a clearly felt need in the art for a protection bumper for a vehicle handling fork, which protects a front of a front bumper of a vehicle from damage that may be caused during use of the vehicle handling fork and which protects front bumpers of vehicles with different bumper bottom to frame distances.

SUMMARY OF THE INVENTION

The present invention provides a protection bumper for a vehicle handling fork, which protects front bumpers of vehicles with different bumper bottom to frame distances. The protection bumper for a vehicle handling fork (protection bumper) preferably includes a bumper portion and an attachment bracket. The bumper portion preferably includes the shape of a substantial right hand triangle. A horizontal side and a vertical side of the bumper portion make contact with horizontal and vertical portions of first and second fork members of the vehicle handling fork. Preferably, at least two through cavities are formed through a thickness of the bumper portion. A first cavity includes a substantially oval shape located near the horizontal side of the bumper portion. A second cavity includes a hole located between a top of the bumper portion and the first cavity. The first and second cavities allow an angled side of the bumper portion to deflect, when a bumper of a vehicle contacts thereof. The attachment bracket preferably includes a C-shaped cross section. An inside width of the C-shaped cross section is sized to receive a thickness of the bumper portion. The attachment bracket is preferably attached to the bumper portion with at least one fastener. The attachment bracket may be welded to a vertical portion of one of fork members. Alternatively, a bottom of a retention strip is attached to the vertical portion of the vehicle handling fork. The retention plate is slipped into a gap between an inside surface of the attachment bracket and the vertical side of the bumper portion. A top of the retention strip is bolted to the vertical portion of the first or second fork member.

Accordingly, it is an object of the present invention to provide a protection bumper, which protects a front of a vehicle from damage that may be caused during use of the vehicle handling fork.

Finally, it is another object of the present invention to provide a protection bumper, which protects vehicles with different bumper bottom to frame distances.

These and additional objects, advantages, features and benefits of the present invention will become apparent from the following specification.

DETAILED DESCRIPTION OF THE PREFERRED EMBODIMENTS

Figure 1:
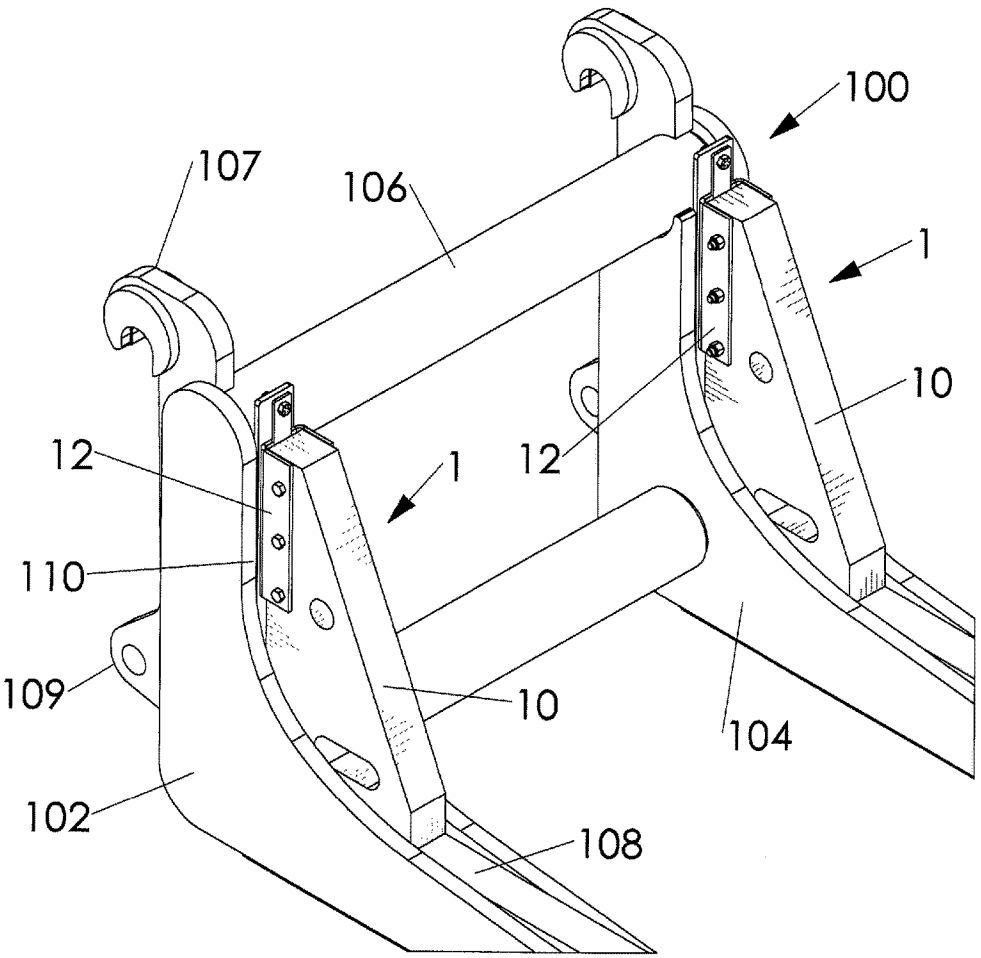
FIG. 1 is a perspective view of a pair of protection bumpers attached to a pair of vertical portions of first and second fork members of a vehicle handling fork in accordance with the present invention.
Figure 3:
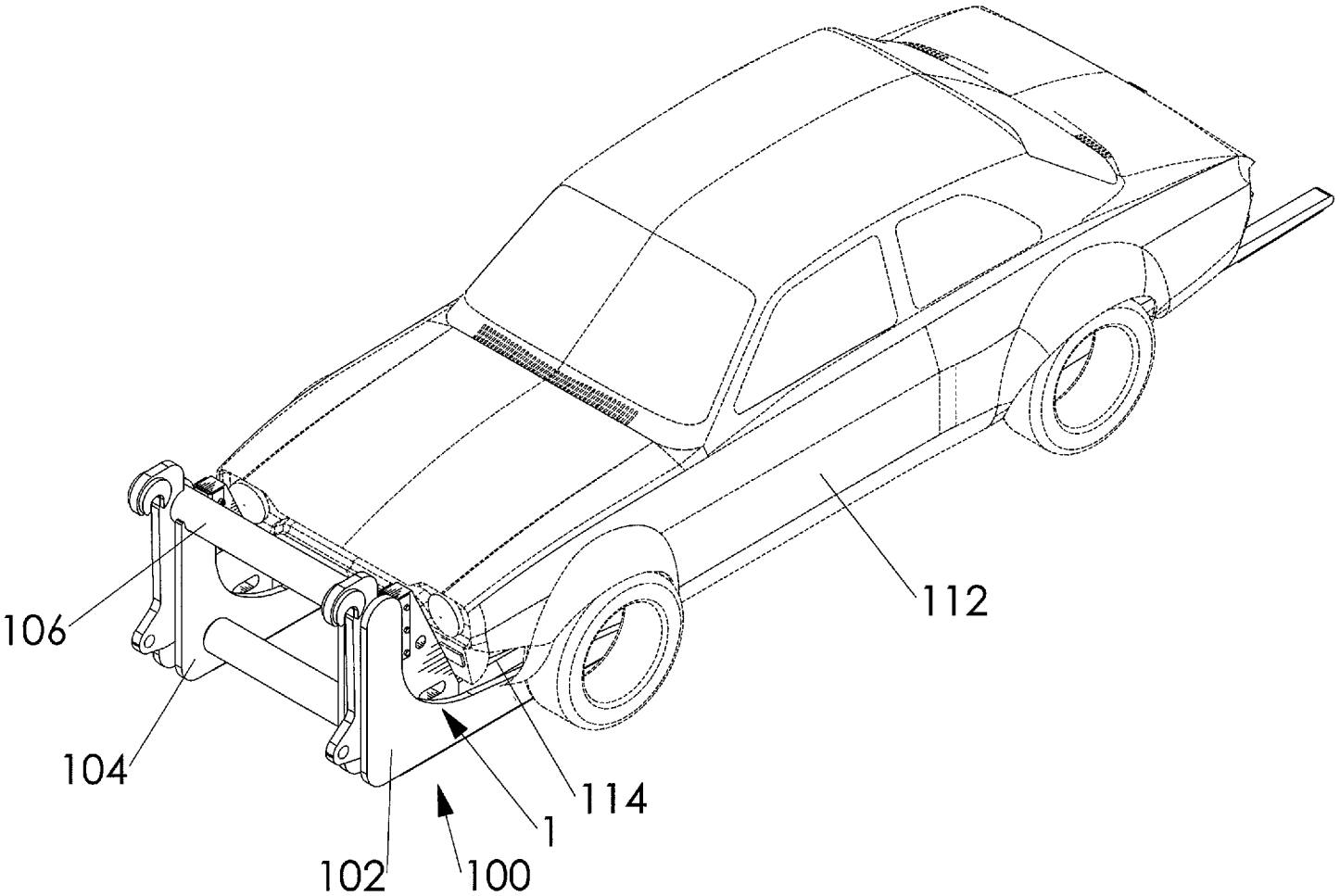
FIG. 3 is a perspective view of a pair of protection bumpers attached to a vertical portion of a first and second fork members of a vehicle handling fork with a small vehicle retained thereupon in accordance with the present invention.
Figure 4:
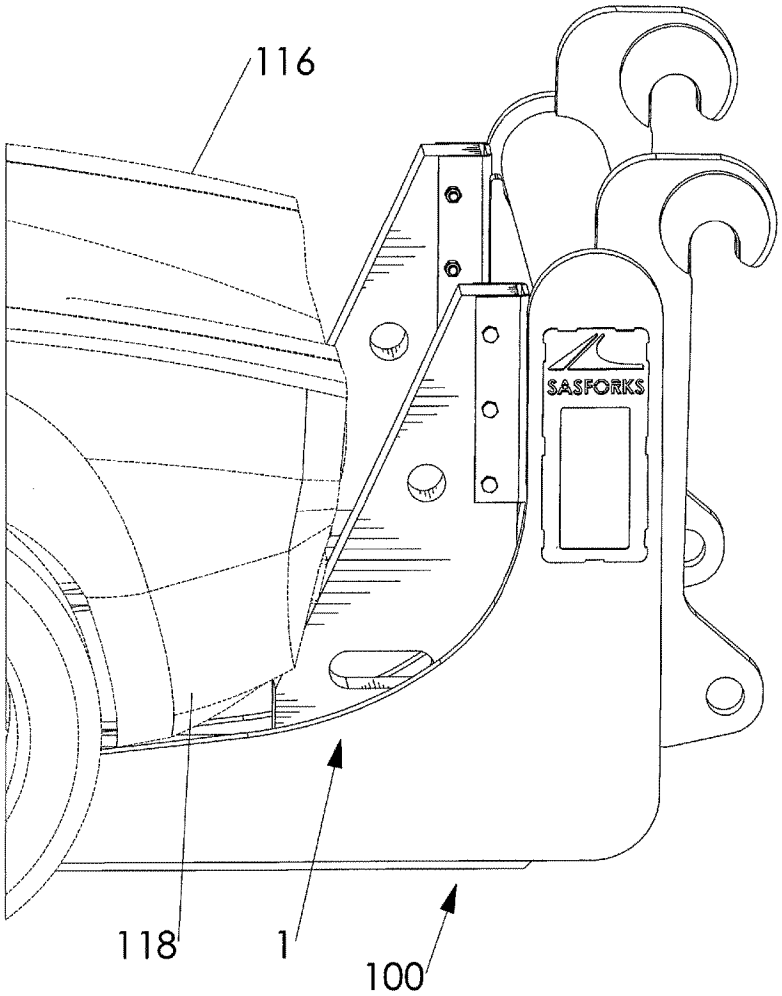
FIG. 4 is a close-up perspective view of a pair of protection bumpers attached to a vertical portion of first and second fork members of a vehicle handling fork with a truck retained thereupon in accordance with the present invention.
Figure 5:
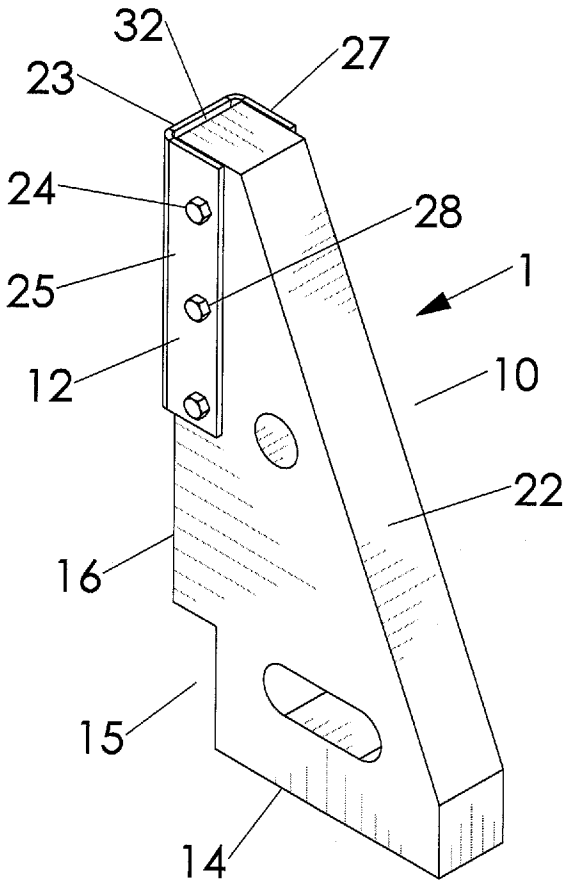
FIG. 5 is a perspective view of a protective bumper in accordance with the present invention.
Figure 6:
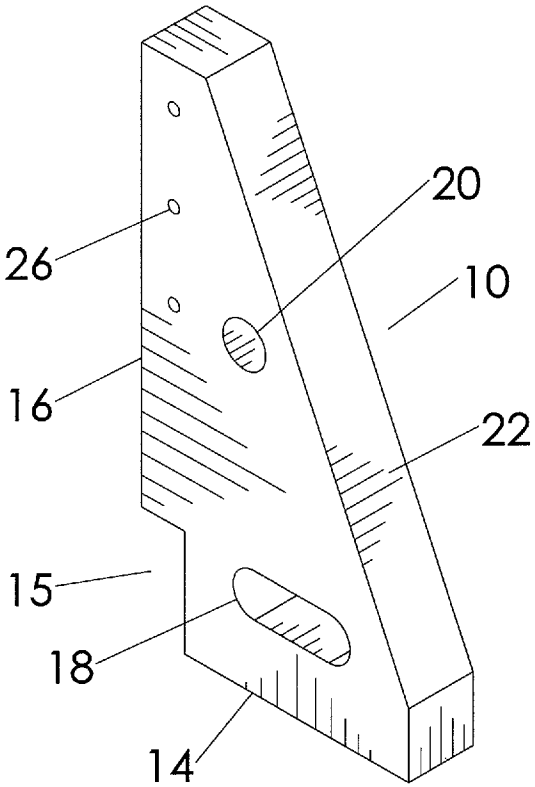
FIG. 6 is a perspective view of a bumper portion of a protective bumper in accordance with the present invention.

With reference now to the drawings, and particularly to FIG. 1, there is shown a perspective view of pair of protection bumpers 1 attached to a vehicle handling fork 100. The vehicle handling fork 100 includes a first fork member 102, a second fork member 104 and a frame 106. Each fork member 102, 104 includes a horizontal portion 108 and a vertical portion 110. The frame 106 is capable of being attached to an auto salvage forklift (not shown) or any other suitable piece of mobile lift equipment. The frame 106 may be converted into a quick release frame by adding hooks 107 and lugs 109. With reference to FIG. 5, the protection bumper 1 preferably includes a bumper portion 10 and an attachment bracket 12. The bumper portion 10 preferably includes the shape of a substantial right hand triangle. A horizontal side 14 and the vertical side 16 of the bumper portion 10 make contact with the horizontal and vertical portions 108, 110 of the first and second fork members 102, 104. The vertical side 16 has a greater length than the horizontal side 14. A clearance notch 15 is preferably formed at a junction of the horizontal side 14 and the vertical side 16. At least two through cavities are preferably formed through a thickness of the bumper portion 10. A first cavity 18 includes a substantially oval shape located near the horizontal side 14 of the bumper portion 10. A second cavity 20 includes a hole located between a top of the bumper portion 10 and the first cavity 18. With reference to FIG. 3, the first cavity 18 allows an angled side 22 to deflect when a bumper 114 of a small vehicle 112 pushes against thereof. With reference to FIG. 4, the second cavity 20 allows the angled side 22 to deflect when a bumper 118 of a truck 116 pushes against thereof. The bumper portion 10 is preferably fabricated from a resilient material, which absorbs impact such as rubber with a durometer rating of 70-80.

Figure 2:
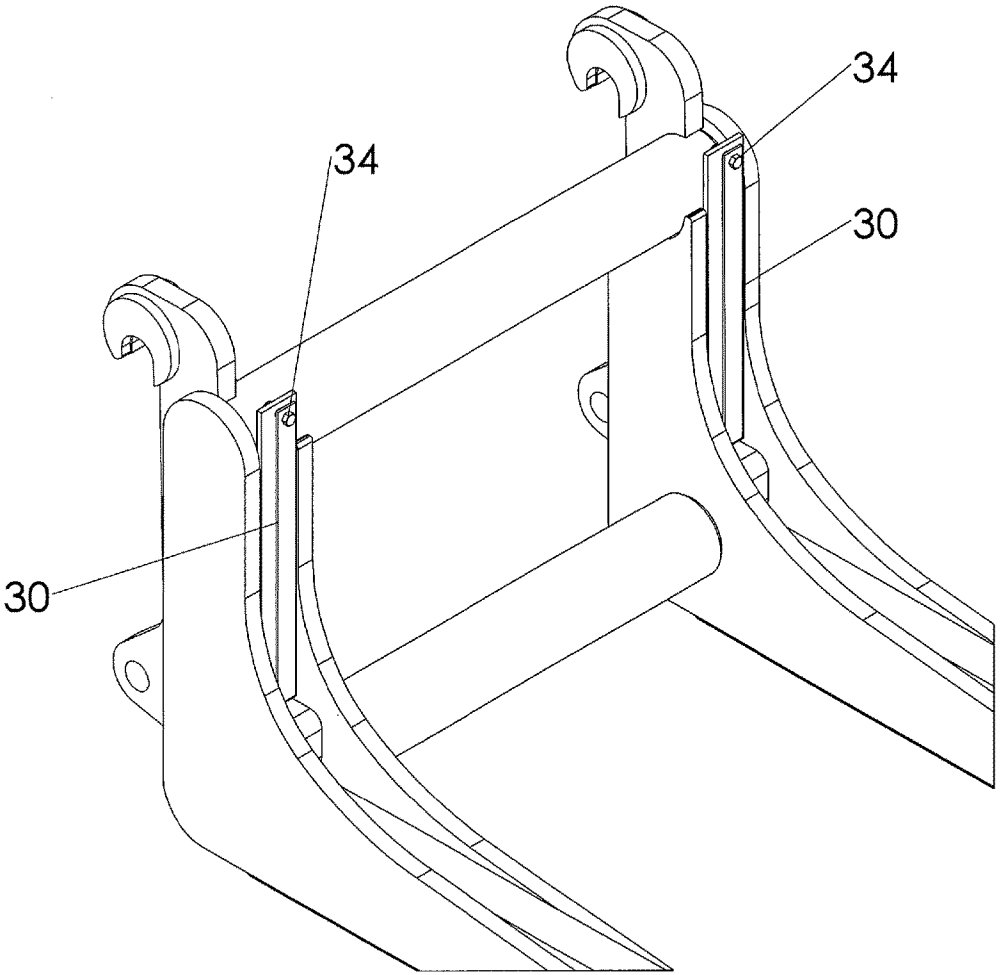
FIG. 2 is a perspective view of a pair of vertical portions with a pair of retention strips attached thereto of a vehicle handling fork for retaining a pair protection bumpers in accordance with the present invention.

The attachment bracket 12 preferably includes a C-shaped cross section having a base 23, a first leg 25 and a second leg 27. The first leg 25 extends outward from a first edge of the base 23 and the second leg 27 extends outward from a second edge of the base 23. A width between the first and second legs 25, 27 is sized to receive a thickness of the bumper portion 10. The attachment bracket 12 is preferably attached to the bumper portion 10 with at least one fastener 24. At least one bumper hole 26 is formed through the bumper portion 10, adjacent the vertical side 16. At least one bracket hole 28 is formed through a cross section of the attachment bracket 12. The at least one fastener is inserted through the holes 26, 28 and tightened to retain the attachment bracket 12 on the bumper portion 10. The attachment bracket 12 may be welded to the vertical portion 110 of the first and second fork members 102, 104. With reference to FIG. 2, a bottom of a retention strip 30 is attached to the vertical portion 110 of the first and second fork members 102, 104. The retention strip 30 is inserted into a gap 32 between an inside surface of the attachment bracket 12 and the vertical side 16 of the bumper portion 10. A top of the retention strip 30 is preferably attached to the vertical portion 102 with a fastener 34.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A protection bumper for a vehicle handling fork, comprising:

a bumper portion includes a horizontal side, a vertical side and an angled side, said bumper portion is fabricated from a resilient material;

a retainer strip is attached to a vertical portion of a fork member of the vehicle handling fork; and an attachment bracket is attached to said bumper portion such that a gap is created between said vertical side of said bumper portion and an inside surface of said attachment bracket, wherein said gap is sized to receive said retainer strip, said retainer strip retains said bumper portion relative to the vertical portion, one side of said retainer strip is in contact with said bumper portion, an opposing side of said retainer strip is in contact with said attachment bracket.

2. The protection bumper for a vehicle handling fork of claim 1 wherein:

a first cavity of said at least one cavity is formed in said bumper portion near said horizontal side of said bumper portion.

3. The protection bumper for a vehicle handling fork of claim 2 wherein:

a second cavity of said at least one cavity is formed in said bumper portion between a top of said bumper portion and said first cavity.

4. The protection bumper for a vehicle handling fork of claim 1 wherein:

said bumper portion has a general shape of a right hand triangle.

5. The protection bumper for a vehicle handling fork of claim 1 wherein:

said attachment bracket includes a C-shaped cross section, said C-shaped cross section is sized to receive a thickness of said bumper portion.

6. A protection bumper for a vehicle handling fork, comprising:

a bumper portion includes a horizontal side, a vertical side and an angled side, said bumper portion is fabricated from a resilient material;

a retainer strip is removably attached to a vertical portion of a fork member of the vehicle handling fork with at least one fastener; and an attachment bracket is attached to said bumper portion such that a gap is created between said vertical side of said bumper portion and an inside surface of said attachment bracket, wherein said gap is sized to receive said retainer strip, said retainer strip retains said bumper portion relative to the vertical portion, one side of said retainer strip is in contact with said bumper portion, an opposing side of said retainer strip is in contact with said attachment bracket.

7. The protection bumper for a vehicle handling fork of claim 6 wherein:

a first cavity of said at least one cavity is formed in said bumper portion near said horizontal side of said bumper portion.

8. The protection bumper for a vehicle handling fork of claim 7 wherein:

a second cavity of said at least one cavity is formed in said bumper portion between a top of said bumper portion and said first cavity.

9. The protection bumper for a vehicle handling fork of claim 6 wherein:

said bumper portion has a general shape of a right hand triangle.

10. The protection bumper for a vehicle handling fork of claim 6 wherein:

said attachment bracket includes a C-shaped cross section, said C-shaped cross section is sized to receive a thickness of said bumper portion.

* * * * *